US008228237B2

(12) United States Patent
Teng et al.

(10) Patent No.: US 8,228,237 B2
(45) Date of Patent: Jul. 24, 2012

(54) ANTENNA WITH DOUBLE GROUNDINGS

(75) Inventors: Pei-Ling Teng, Taoyuan County (TW); Yi-Chun Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 511 days.

(21) Appl. No.: 12/484,252

(22) Filed: Jun. 15, 2009

(65) Prior Publication Data

US 2010/0214191 A1 Aug. 26, 2010

(30) Foreign Application Priority Data

Feb. 23, 2009 (TW) ..... 98105651 A

(51) Int. Cl.
*H01Q 1/38* (2006.01)

(52) U.S. Cl. ..... 343/700 MS; 343/702

(58) Field of Classification Search ..... 343/702, 343/700 MS, 846, 848
See application file for complete search history.

(56) References Cited

U.S. PATENT DOCUMENTS

| | | | | |
|---|---|---|---|---|
| 5,852,421 | A * | 12/1998 | Maldonado | 343/702 |
| 2005/0088347 | A1 * | 4/2005 | Vance et al. | 343/702 |
| 2009/0128426 | A1 * | 5/2009 | Wang et al. | 343/702 |
| 2009/0135071 | A1 * | 5/2009 | Huang et al. | 343/700 MS |
| 2009/0295643 | A1 * | 12/2009 | Angell et al. | 343/700 MS |

* cited by examiner

*Primary Examiner* — Hoanganh Le
(74) *Attorney, Agent, or Firm* — Jianq Chyun IP Office

(57) ABSTRACT

An antenna with double groundings, including a body part, a feeding part, a first grounding part, and a second grounding part, is provided. The body part is electrically connected to the feeding part, the first grounding part, and the second grounding part respectively. The body part is corresponding to a resonance length to transmit and receive a radiation wave with a wavelength at an operating frequency. Wherein, a current path from the first grounding part to the feeding part along the body part is ½ times of the wavelength at the operating frequency, and a relative distance between the second grounding part and the first grounding part is ¼ times of the wavelength at the operating frequency.

22 Claims, 11 Drawing Sheets

ANTENNA WITH DOUBLE GROUNDINGS

CROSS-REFERENCE TO RELATED APPLICATION

This application claims the priority benefit of Taiwan application serial No. 98105651, filed on Feb. 23, 2009. The entirety of the above-mentioned patent application is hereby incorporated by reference herein and made a part of this specification.

BACKGROUND OF THE INVENTION

1. Field of the Invention

The present invention is related to an antenna and particularly to an antenna with double groundings.

2. Description of Related Art

In view of the research of wireless communication, different systems have diversified frequencies and bandwidths, and require different designs of radiation patterns and polarizations of the wave radiated by the antenna from time to time. In addition, the environment of mobile communication is full of interference and variables. An antenna not only needs to coordinate the frequency, bandwidth, pattern of radiation wave, and polarization, but is required to overcome problems, such as interference of multipath, transition of radiation wave polarization, change of radiation wave pattern, and size, weight, and shape of the antenna. Among the above, the interference of multipath causes fading during the transmission of signal and greatly reduces the reliability of the wireless communication system.

At present, the means to overcome the fading problem is to use spatial diversity, pattern diversity, and polarization diversity of the antenna. In view of the design, a circularly polarized antenna has no particular polarization direction when receiving or transmitting radiation waves, and thus is able to overcome the influence of phase difference resulting from multipath interference. For this reason, antennas of satellite communication systems, global positioning systems, microwave AV monitor systems, electronic charging systems, microwave remote control and microwave measuring systems, and so forth all adopt circular polarization design for transmitting signals.

FIG. 1A and FIG. 1B respectively illustrate a structural view and a radiation wave pattern of a conventional circularly polarized antenna. The conventional circularly polarized antenna has a radiating patch 110 printed on a ceramic substrate 120 which is disposed on a symmetrical ground plane 130. The "symmetrical" mentioned here indicates that the distance from the periphery of the ceramic substrate 120 to the periphery of the ground plane 130 is equal. The radiating patch 110 is basically a square metal plane. An isosceles triangle is respectively cut off from a lower left corner and a upper right corner of the square metal plane, and the path difference thereof is based on to determine the properties of the radiation wave. When the conventional circularly polarized antenna in FIG. 1A is placed on the symmetrical ground plane 130, a radiation pattern as illustrated in FIG. 1B is generated, wherein the largest gain of the radiation wave is along a +z direction (a vertex direction).

However, in the current communication products, the design of the circularly polarized antenna, which has a structure of FIG. 2A, is usually limited to the shapes and systems of the products, and thus needs to be disposed on an unsymmetrical ground plane 130. In other words, the conventional circularly polarized antenna is restricted to a certain area of the ground plane 130, and cannot be disposed on the symmetrical ground plane. Compared with the radiation pattern in FIG. 1B, when the circularly polarized antenna is placed on the unsymmetrical ground plane shown in FIG. 2B, the gain of the radiation wave in the +z direction (vertex direction) apparently decreases and impairs the reception of the antenna. That is to say, the conventional circularly polarized antenna loses the property of circular polarization when applied to the current communication products, for the configuration and position thereof are limited.

SUMMARY OF THE INVENTION

The present invention provides an antenna with double groundings which is designed to include two ground parts for generating two orthogonal linearly polarized waves, and thereby forms a radiation wave approximating to circular polarization. Based on the technical means of the present invention, the gain of circular polarization radiation wave is achieved and the arrangement of the antenna becomes more flexible.

The present invention provides an antenna with double groundings which uses two ground parts in parallel to a feeding part for generating a radiation wave approximating circular polarization.

The present invention provides an antenna with double groundings, including a body part, a feeding part, a first grounding part, and a second grounding part. Herein, the body part is electrically connected to the feeding part, the first grounding part, and the second grounding part, and the body part is corresponding to a resonance length for transmitting and receiving a radiation wave. In addition, a current path from the first grounding part to the feeding part along the body part is ½ times of the wavelength at operating frequency. A relative distance is maintained between the second grounding part and the first grounding part. It is noted that the resonance length is in a range of ⅓~⅕ times of the wavelength at operating frequency.

In an embodiment of the present invention, the relative distance between the first grounding part and the second grounding part is ¼ times of the wavelength at operating frequency.

In an embodiment of the present invention, the body part includes a first conductive element, a second conductive element, and a third conductive element. More specifically, each of the first conductive element, the second conductive element, and the third conductive element has a first end and a second end. The first end of the second conductive element is electrically connected to the first end of the first conductive element, and further, the first end of the third conductive element is electrically connected to the second end of the first conductive element. Moreover, the second conductive element is electrically connected to the feeding part, the first grounding part, and the second grounding part.

In an embodiment of the present invention, the second conductive element of the antenna with double groundings is electrically connected to the feeding part via a feeding point, and a current path from the feeding point to the second end of the third conductive element is equal to the resonance length.

In an embodiment of the present invention, the first grounding part and the second grounding part of the antenna with double groundings are arranged on one side of the feeding part along a direction towards the second end of the second conductive element, and the widths of the first conductive element, the second conductive element, and the third conductive element are equal to one another.

In an embodiment of the present invention, the first grounding part and the second grounding part of the antenna with double groundings are respectively disposed on two sides of the feeding part, and the width of the third conductive element is larger than the width of the second conductive element. Furthermore, in the antenna with double groundings, a ratio of the width of the third conductive element to the width of the second conductive element is in a range of 1.5 to 2.

In an embodiment of the present invention, the first grounding part and the second grounding part of the antenna with double groundings are arranged on one side of the feeding part along a direction towards the first end of the second conductive element, and the widths of the second conductive element and the third conductive element are respectively larger than the width of the first conductive element.

In an embodiment of the present invention, a ratio of the width of the second conductive element to the width of the first conductive element and a ratio of the width of the third conductive element to the width of the first conductive element are in a range of 1.5 to 2.

From another aspect, the present invention further provides an antenna with double groundings, including a body part, a feeding part, a first grounding part, and a second grounding part. Specifically, the body part is electrically connected to the feeding part, the first grounding part, and the second grounding part. In addition, the body part with a feeding point extends a resonance length for transmitting and receiving a radiation wave. The feeding part is electrically connected to the body part via the feeding point. The first grounding part and the second grounding part are arranged in parallel to the feeding part. Herein, a current path from the first grounding part to the feeding part along the body part is ½ times of the wavelength at operating frequency, and a relative distance between the first grounding part and the second grounding part is ¼ times of the wavelength at operating frequency. It is noted that the resonance length is in a range of ⅓~⅕ times of the wavelength at operating frequency.

Based on the above, the antenna of the present invention is designed to include two ground parts for generating two orthogonal linearly polarized waves and thereby forms a radiation wave approximating to circular polarization. Accordingly, the antenna with double groundings of the present invention has advantages in terms of miniaturization and is applicable to the transmission of radiation wave between global positioning systems, electronic products, and satellites.

To make the above features and advantages of the present invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In the following paragraphs, elements having identical or similar functions and structures are assigned with the same reference numbers and terms for consistency.

First Embodiment

Figure 1A:
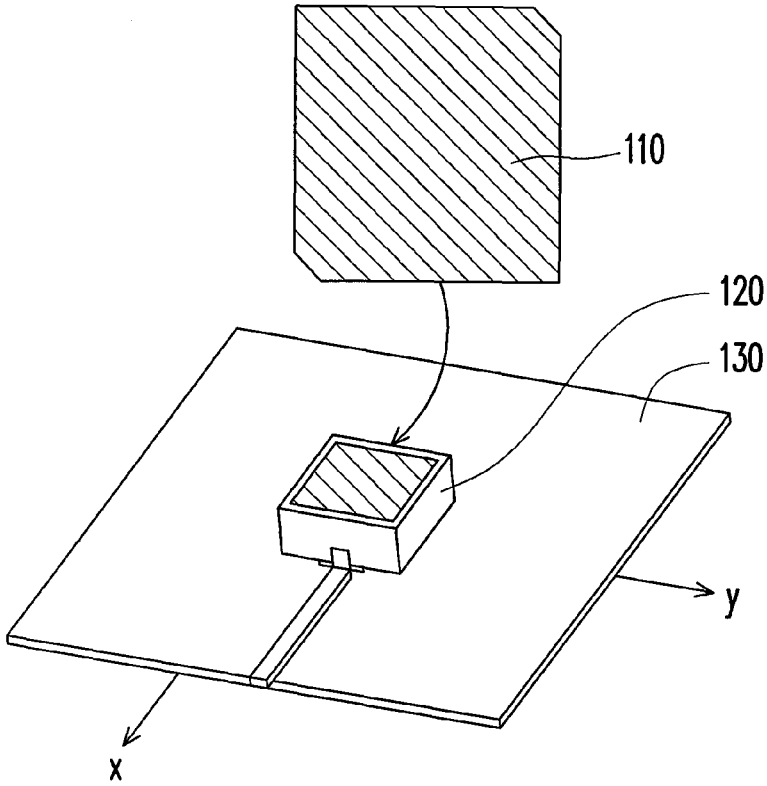
FIG. 1A (RELATED ART)
FIG. 1A and FIG. 1B respectively illustrate a structural view and a radiation pattern of a conventional circularly polarized antenna.
Figure 1B:
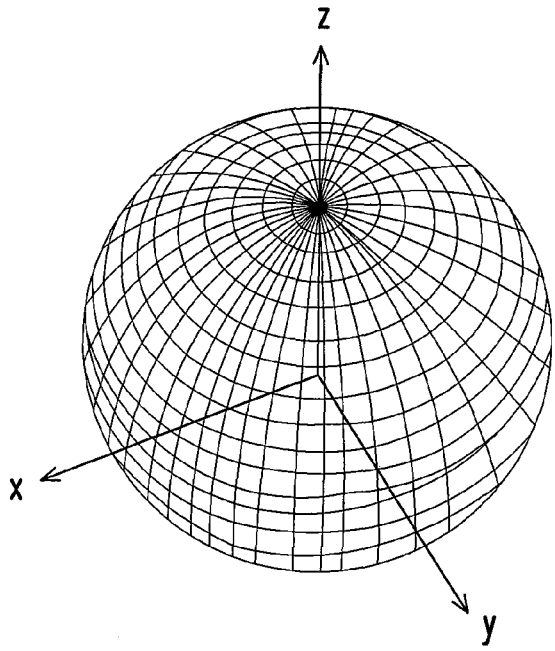
FIG. 1B (RELATED ART)
Figure 2A:
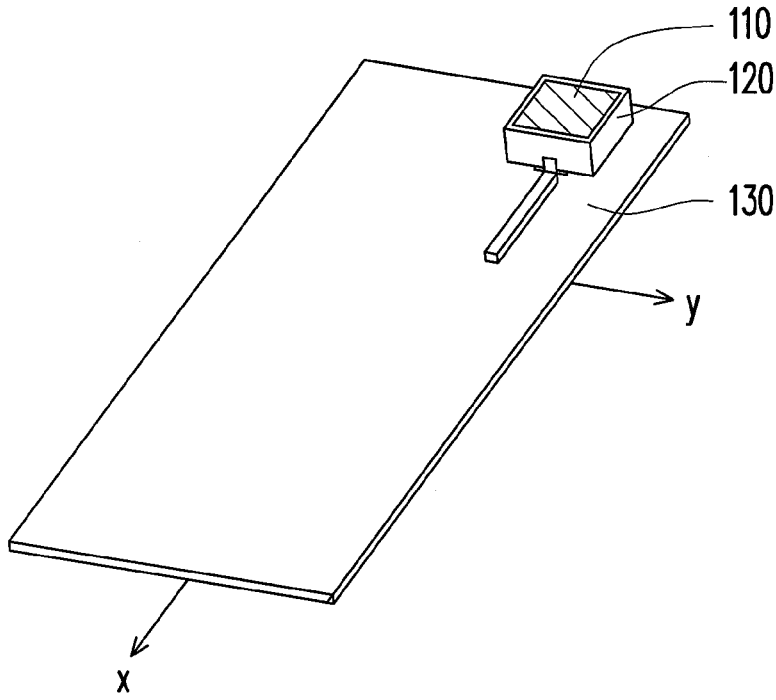
FIG. 2A illustrates a structural view of an application of a conventional circularly polarized antenna.
Figure 2B:
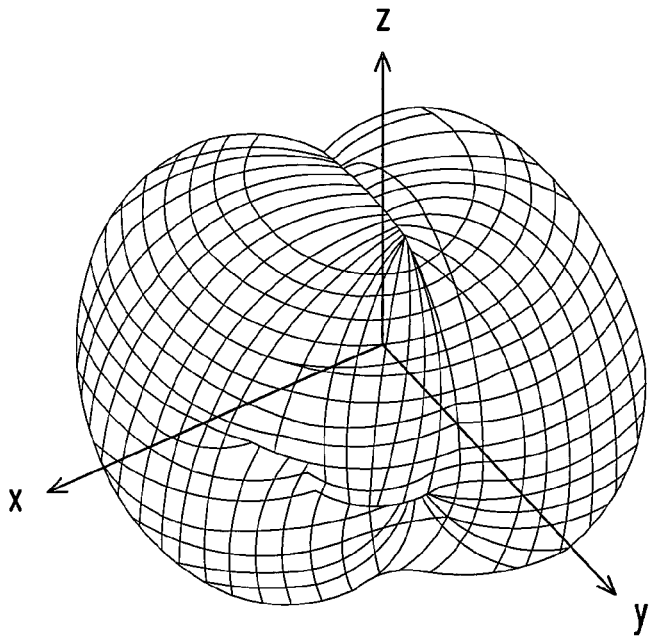
FIG. 2B illustrates a radiation pattern of a conventional circularly polarized antenna on an asymmetric ground plane.
Figure 3A:
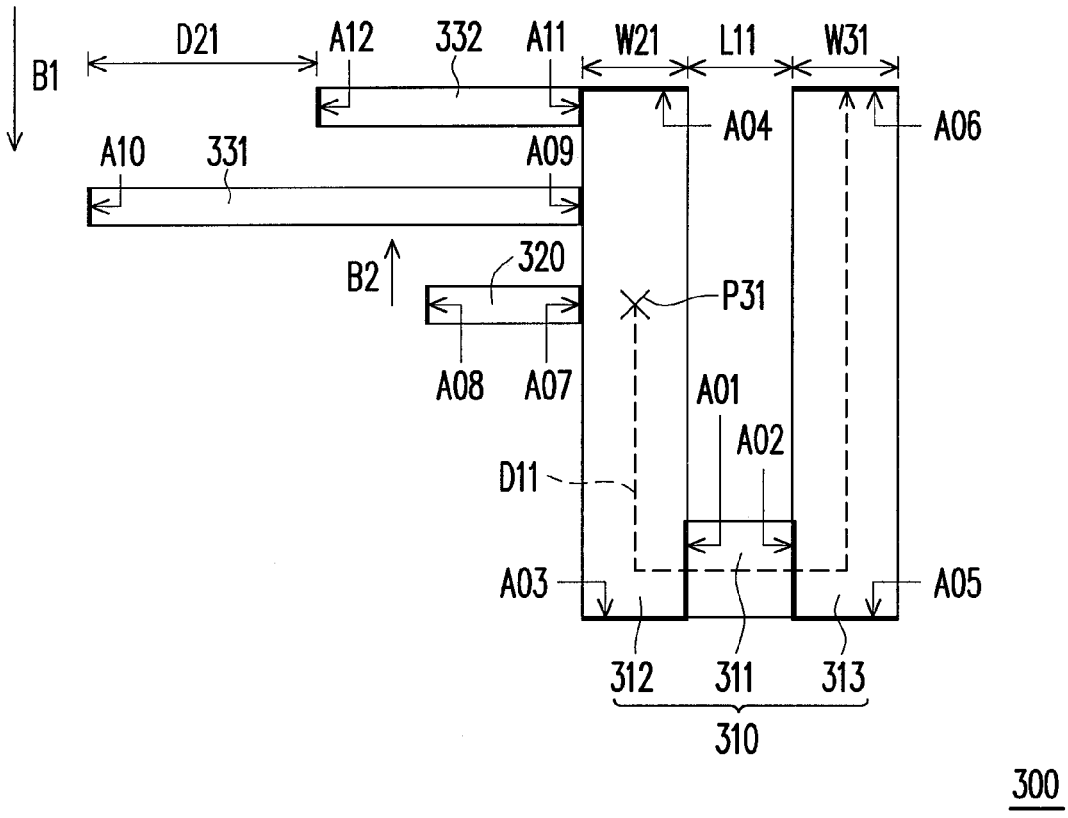
FIG. 3A illustrates a structural view of a planar inverted-F antenna according to one embodiment of the present invention.

FIG. 3A illustrates a structural view of a planar inverted-F antenna according to one embodiment of the present invention. Referring to FIG. 3A, a planar inverted-F antenna 300 includes a body part 310, a feeding part 320, a first grounding part 331, and a second grounding part 332. Specifically, the body part 310 includes a first conductive element 311, a second conductive element 312, and a third conductive element 313.

To be more detailed, the first conductive element 311 has two ends, which are respectively marked as A01 and A02; the second conductive element 312 has two ends, respectively marked as A03 and A04; the third conductive element 313 has two ends, respectively marked as A05 and A06; the feeding part 320 has two ends, respectively marked as A07 and A08; the first grounding part 331 has two ends, respectively marked as A09 and A10; and the second grounding part 332 has two ends, respectively marked as A11 and A12.

As shown in FIG. 3A, the first end A01 of the first conductive element 311 is electrically connected to the first end A03 of the second conductive element 312, and the second end A02 of the first conductive element 311 is electrically connected to the first end A05 of the third conductive element 313. Additionally, the second end A07 of the feeding part 320 is electrically connected to the second conductive element 312 via a feeding point P31. The second end A09 of the first grounding part 331 is electrically connected to the second conductive element 312 of the body part 310. Furthermore, the second end A11 of the second grounding part 332 is electrically connected to the second conductive element 312 of the body part 310.

In view of the configuration of the elements in the planar inverted-F antenna 300, the first grounding part 331, the second grounding part 332, and the feeding part 320 are arranged in parallel to one another. In addition, in the aspect of the second end A04 of the second conductive element 312, the second grounding part 332, the first grounding part 331, and the feeding part 320 are sequentially disposed on one side of the second conductive element 312 along a direction B1 towards the first end A03 of the second conductive element 312. From the aspect of the feeding point P31, the feeding part 320, the first grounding part 331, and the second grounding part 332 are sequentially arranged on one side of the second conductive element 312 along a direction B2 towards the second end A04 of the second conductive element 312.

Referring to FIG. 3A, a width W11 of the first conductive element, a width W21 of the second conductive element, and a width W31 of the third conductive element are equal to one another. More specifically, the configuration of the elements of the body part 310 is to adjust the impedance matching and excitation current of the planar inverted-F antenna 300. Herein, the intensity and distribution of the excitation current are related to the length of the planar inverted-F antenna 300 and the resonance frequency to be achieved, and a current path of the excitation current is marked as D11 in FIG. 3A. Under a resonance frequency, an effective resonance length of the planar inverted-F antenna 300 is the resonance length which extends from the body part 310 for receiving or transmitting the radiation wave, wherein the resonance length is ⅓~⅕ times of the wavelength at operating frequency, preferably ¼ times of the wavelength (λ) of operating frequency. The current flowing path D11 goes from the feeding point P31 through the ends A01 and A02 to the end A06. In addition, the intensity and distribution of the excitation current are adjustable by varying the widths of the first conductive element 311, the second conductive element 312, and the third conductive element 313 or changing the configuration of the first grounding part 331, the second grounding part 332, and the feeding part 320. That is to say, the measurements (such as lengths and widths) of the first conductive element 311, the second conductive element 312, and the third conductive element 313 of the body part 310 are related to the direction of the current path D11 and the corresponding resonance length thereof.

Furthermore, a current path from the first grounding part 331 to the feeding part 320 along the body part 310, i.e. the current path going from the end A10 through the first grounding part 331, the body part 310, and the feeding part 320 to the end A08, is ½ times of the resonance length (equal to λ/8). A relative distance D21 between the second grounding part 332 and the first grounding part 331, i.e. a vertical gap between the first end A12 of the second group part 332 and the first end A10 of the first grounding part 331, is ¼ times of the wavelength at operating frequency (equal to λ/16).

Figure 4A:
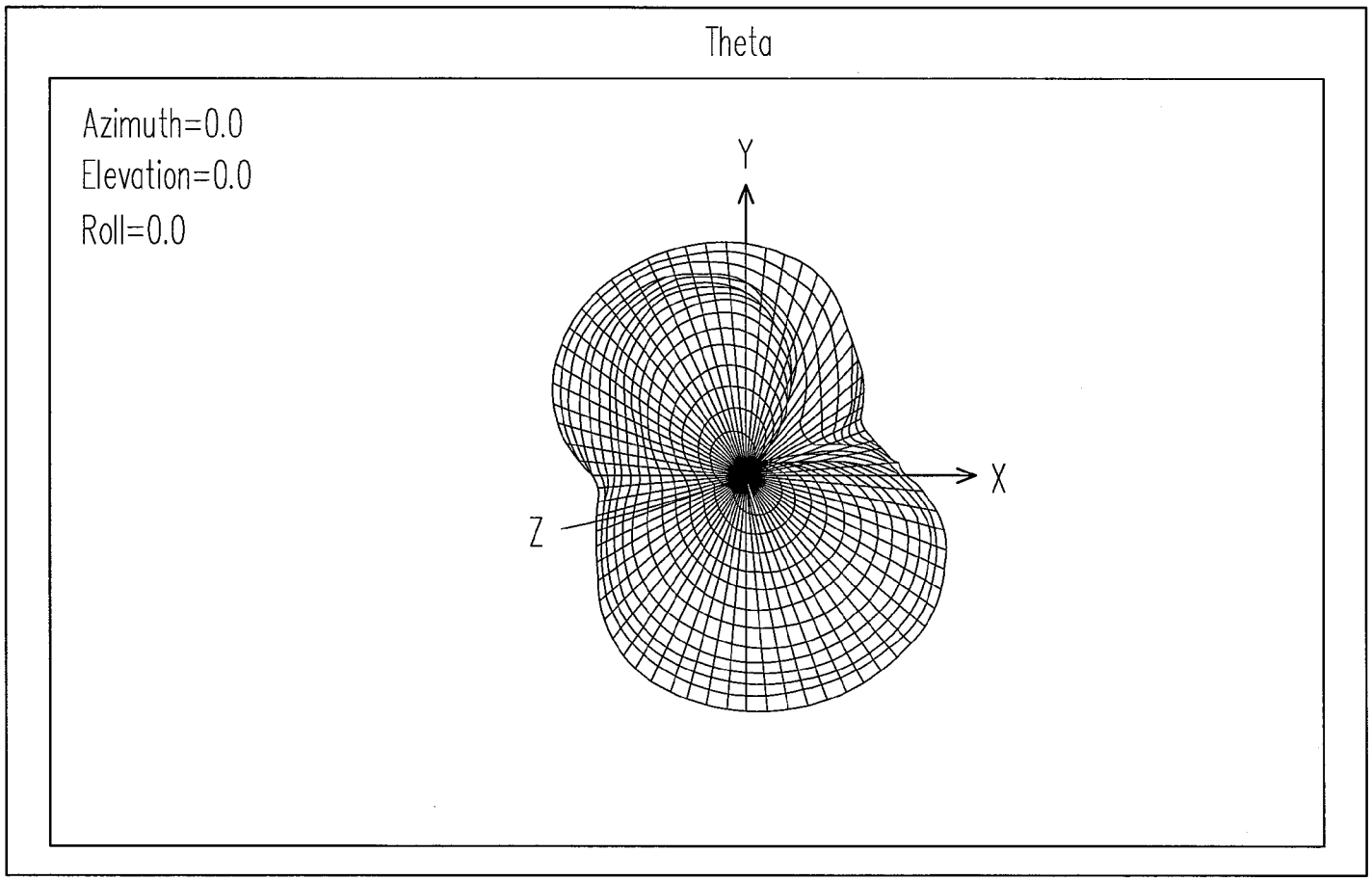
FIG. 4A and FIG. 4B respectively illustrate the radiation patterns in spatial directional angles theta (θ) and phi (ϕ) according to one embodiment of the present invention.
Figure 4B:
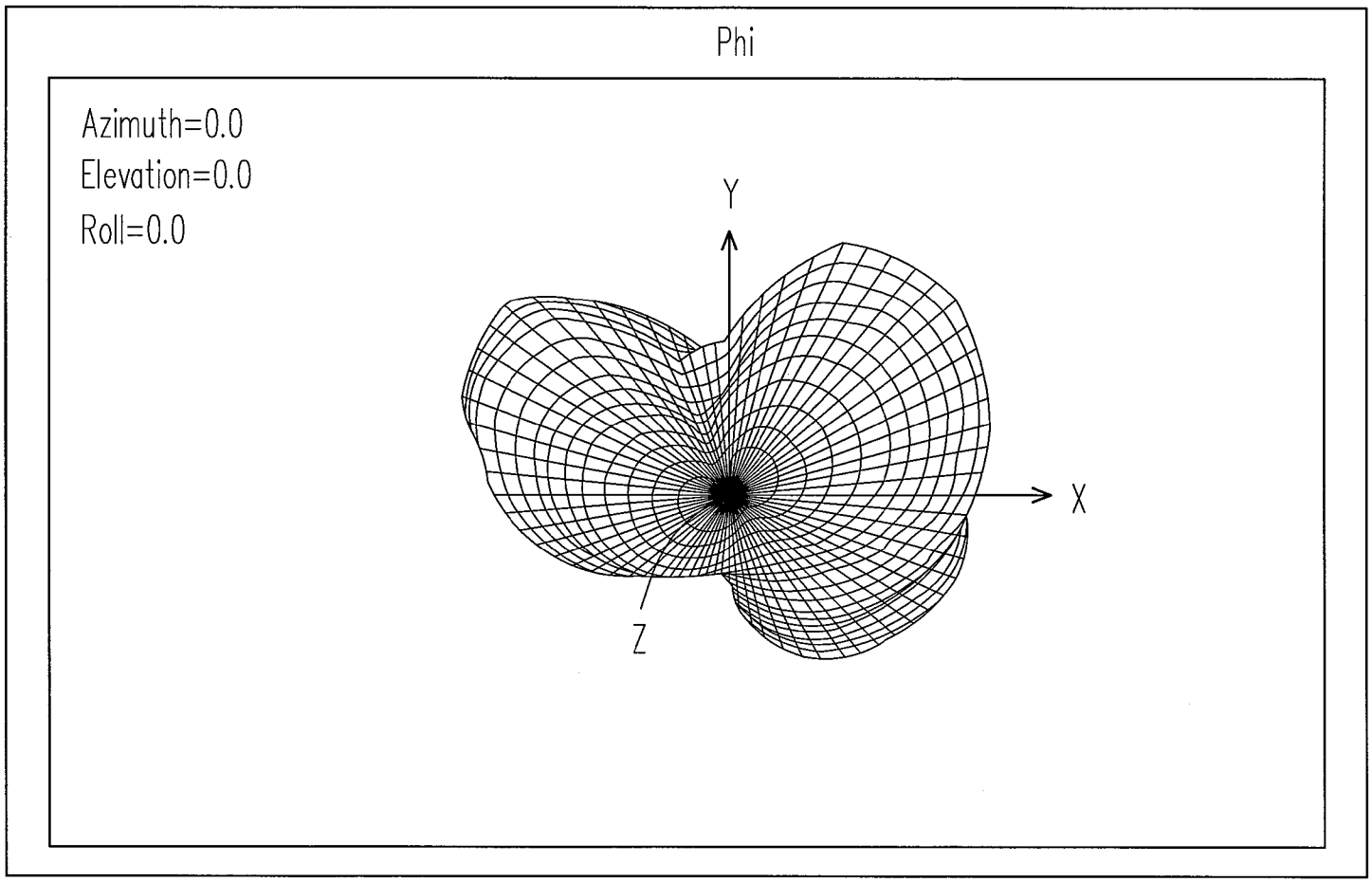
Figure 4C:
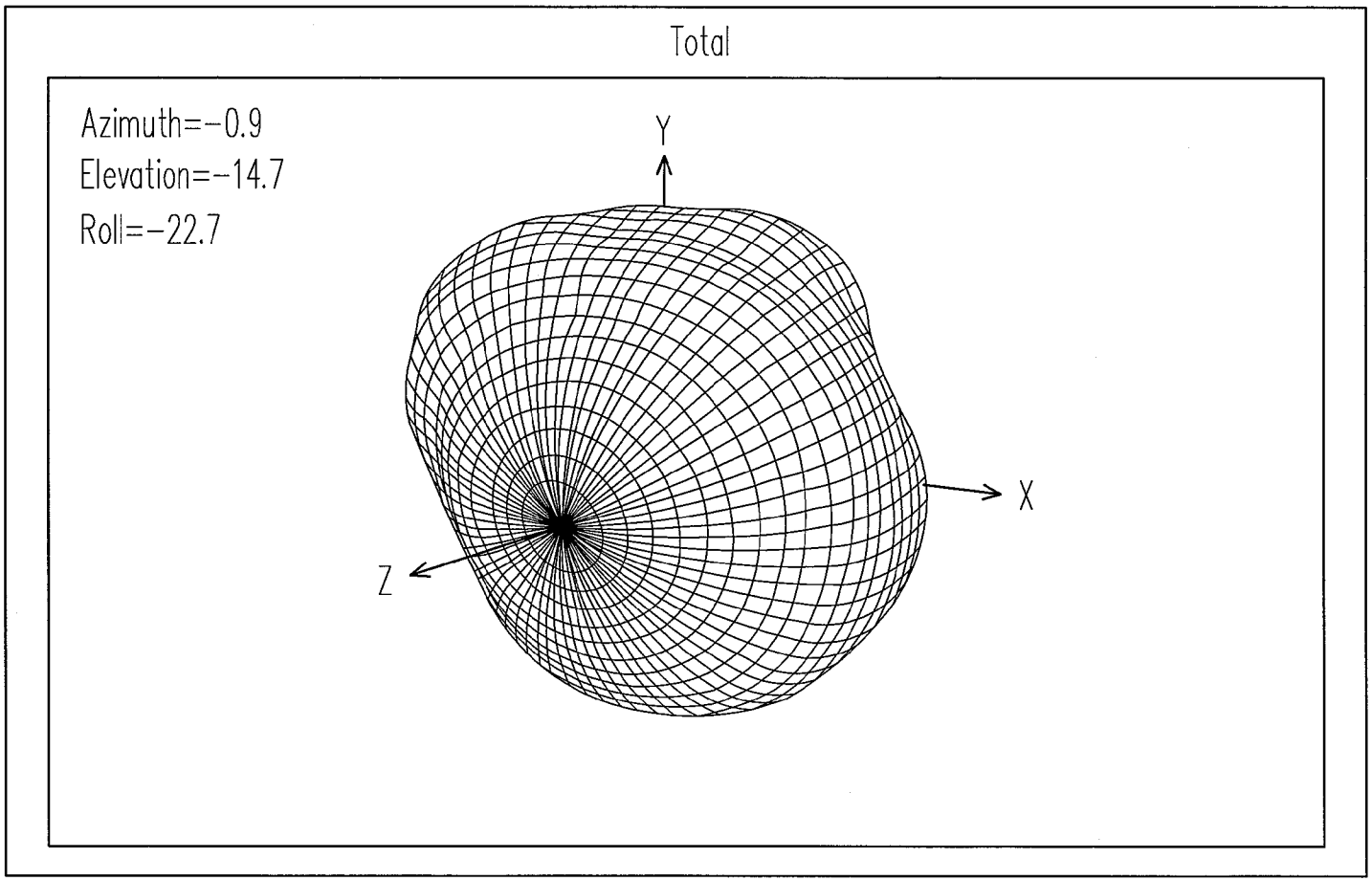
FIG. 4C illustrates a radiation pattern according to one embodiment of the present invention.

In view of the whole operation, the first grounding part 331 and the second grounding part 332 are to adjust an impedance matching of the planar inverted-F antenna 300. Moreover, based on the design of the first grounding part 331 and the second grounding part 332, the planar inverted-F antenna 300 is able to generate two orthogonal linearly polarized waves for forming a radiation wave approximating to circular polarization. For instance, the radiation wave patterns of the planar inverted-F antenna 300 in spatial directional angles theta (θ) and phi (ψ) are illustrated in FIG. 4A and FIG. 4B. Viewing the radiation pattern as a whole, the largest pattern of the planar inverted-F antenna 300 is in a +z direction (a vertex direction), and thus the radiation wave close to circular polarization as shown in FIG. 4C is formed.

Figure 5A:
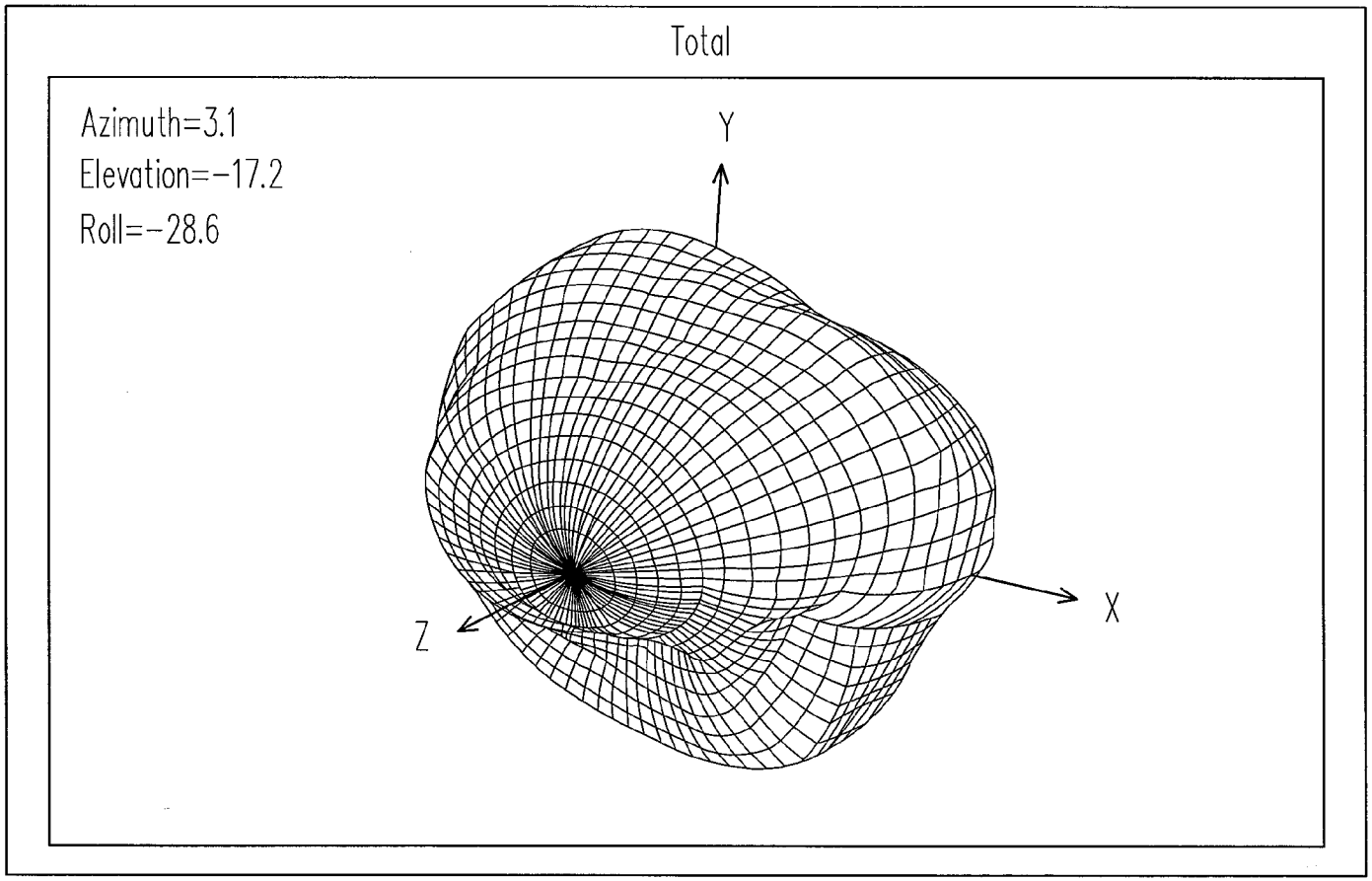
FIG. 5A and FIG. 5B respectively illustrate the radiation patterns of a planar inverted-F antenna only having one ground part.
Figure 5B:
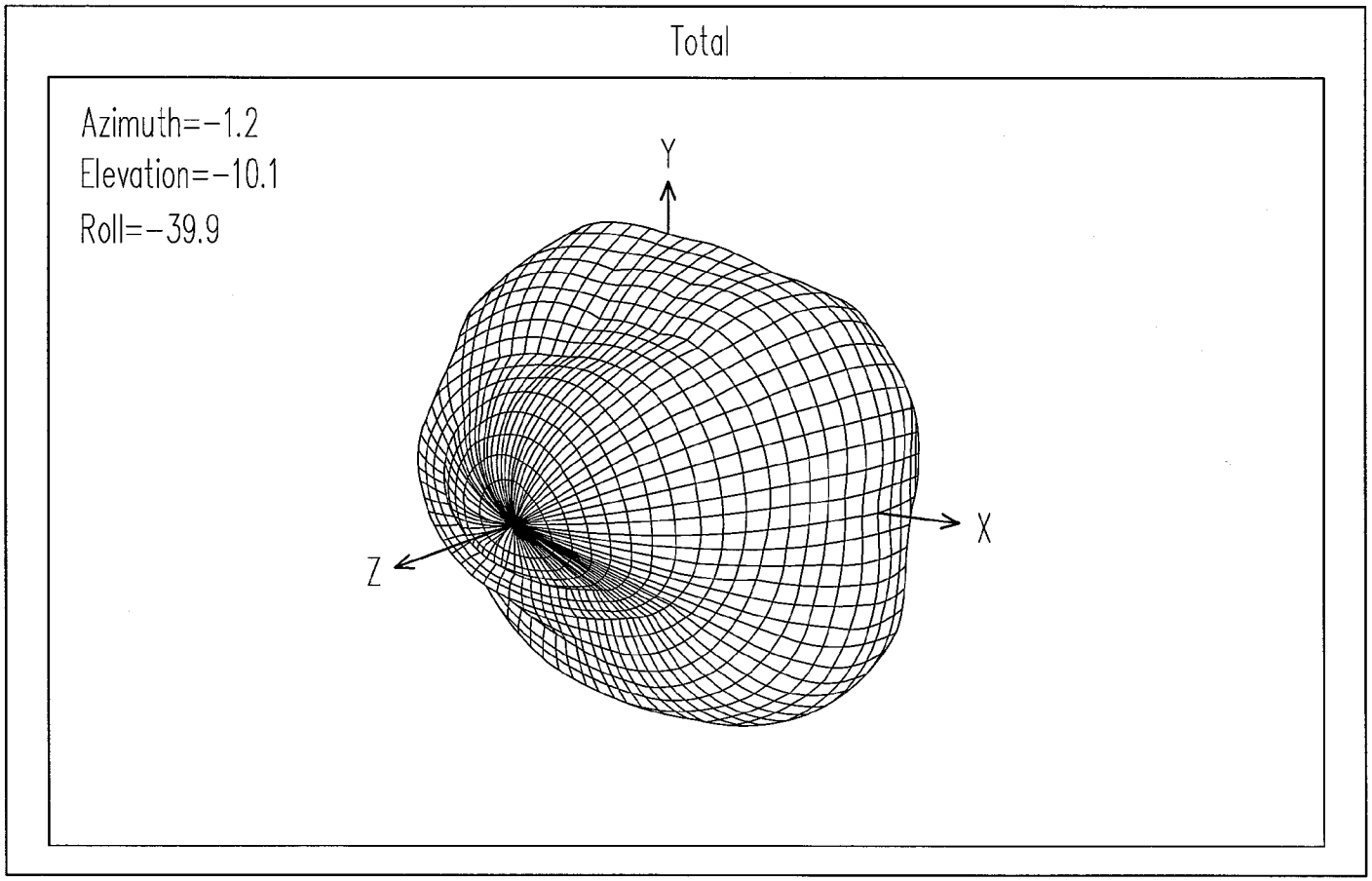
Figure 5C:
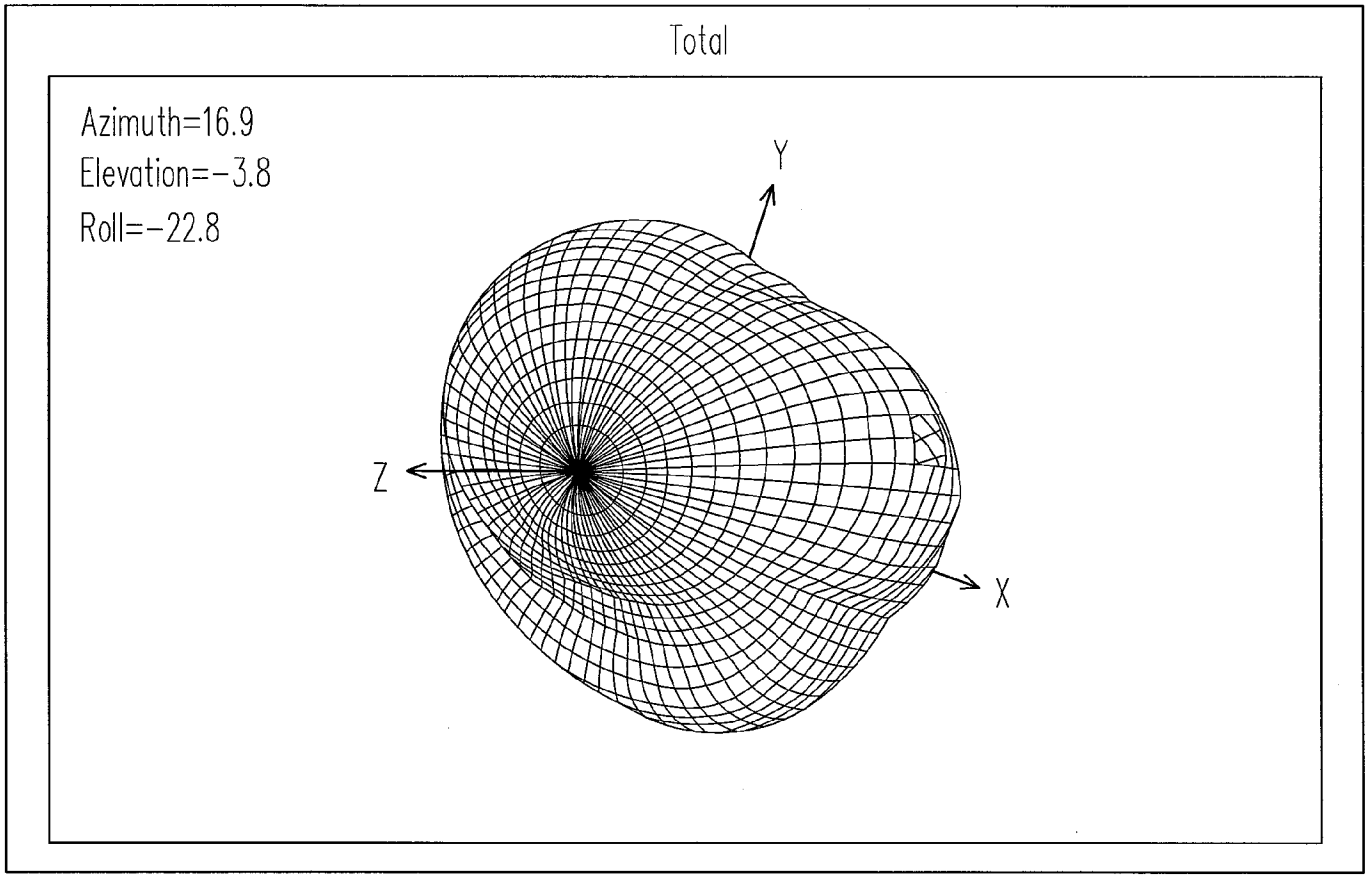
FIG. 5C illustrates a radiation pattern according to another embodiment of the present invention.

On the contrary, if the planar inverted-F antenna 300 in this embodiment only has one ground part, either the first grounding part 331 or the second grounding part 332, instead of two groundings, the pattern of the radiation wave would have apparent nulls, as shown in FIG. 5A and FIG. 5B. When a signal passes around the nulls, the received signal by the antenna would be greatly weakened to affect the transmission quality of the antenna. Based on the design described in this embodiment, even if combined with other factors, such as speakers, cameras, and batteries, that may influence the planar inverted-F antenna 300, the pattern of the radiation wave generated by the planar inverted-F antenna 300 is still maintained close to circular polarization, as shown in FIG. 5C.

In other words, because of the design of the first grounding part 331 and the second grounding part 332, the planar inverted-F antenna 300 of this embodiment is able to generate two orthogonal linearly polarized waves for forming the radiation wave which approximates to circular polarization. Moreover, a circular polarization wave does not have a specific polarization direction when receiving or transmitting radiation waves, and no null is formed. Accordingly, the intensity of signal is maintained and the reception of the antenna would not be influenced. For the above reasons, the planar inverted-F antenna 300 of the embodiment is applicable to the transmission of radiation wave between global positioning systems, electronic products, and satellites.

Second Embodiment

Figure 3B:
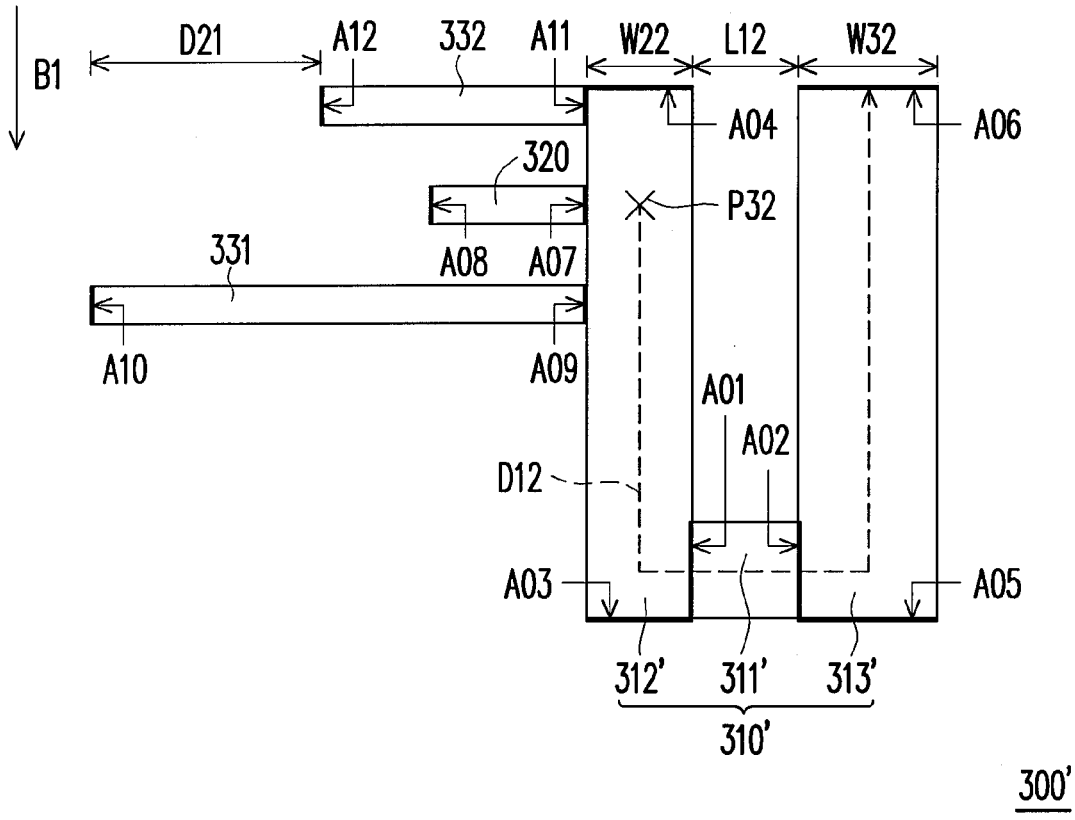
FIG. 3B illustrates a structural view of a planar inverted-F antenna according to another embodiment of the present invention.

FIG. 3B illustrates a structural view of a planar inverted-F antenna according to another embodiment of the present invention. Referring to FIG. 3A and FIG. 3B, the main differences between the first and the second embodiments are the changes of the width of a body part 310', the flowing direction and length of the current path D12, and the sequence and configuration of the feeding part 320, the first grounding part 331, and the second grounding part 332.

Specifically, in this embodiment, the body part 310' includes a first conductive element 311', a second conductive element 312', and a third conductive element 313'. The current path D12 on the body part 310' goes from a feeding point P32 through the ends A01 and A02 to the end A06. In view of the configuration of the elements in a planar inverted-F antenna 300', the second end A07 of the feeding part 320 is electrically connected to the second conductive element 312' via the feeding point P32. The first grounding part 331, the second grounding part 332, and the feeding part 320 are arranged in parallel to one another. In addition, the first grounding part 331 and the second grounding part 332 are respectively disposed on two sides of the feeding part 320. In other words, the second grounding part 332, the feeding part 320, and the first grounding part 331 are sequentially arranged on one side of the second conductive element 312' along the direction B1 towards the first conductive element 311'.

With reference to FIG. 3B, the width of the first conductive element 311' is marked as W12, the width of the second conductive element 312' is marked as W22, and the width of the third conductive element 313' is marked as W32. The width W32 of the third conductive element 313' is larger than the width W22 of the second conductive element 312' and the width W12 of the first conductive element 311'. A ratio (W32/W22) of the width W32 of the third conductive element 313' to the width W22 of the second conductive element 312' is in a range of 1.5 and 2. Further, a ratio (W32/W12) of the width W32 of the third conductive element 313' to the width W12 of the first conductive element 311' is also in the range of 1.5 and 2. To be more detailed, the first grounding part 331 of this embodiment has influence on the intensity and distribution of the excitation current. That is, the first grounding part 331 absorbs a portion of the excitation current and reduces the excitation current in the current path D12. To eliminate the influence the first grounding part 331 causes to the excitation current, the width W32 of the third conductive element 313' in this embodiment is enlarged to increase the excitation current, so as to compensate for the excitation current absorbed by the first grounding part 331.

In addition, similar to the first embodiment, the body part 310' is corresponding to a resonance length, and the resonance length is ⅓~⅕ times of the wavelength at operating frequency, preferably ¼ times of the wavelength at operating frequency of a radiation wave received or transmitted by the body part 310'. A current path from the first grounding part 331 to the feeding part 320 along the body part 310' is ½ times the resonance length. A relative distance D21 between the second grounding part 332 and the first grounding part 331 is ¼ times of the wavelength at operating frequency. Based on the design of the first grounding part 331 and the second grounding part 332, the planar inverted-F antenna 300' of this embodiment is able to generate two perpendicular linearly polarized waves for forming the radiation wave which approximates to circular polarization. Details of this embodiment have been described in the above embodiments and therefore not repeated hereinafter.

Third Embodiment

Figure 3C:
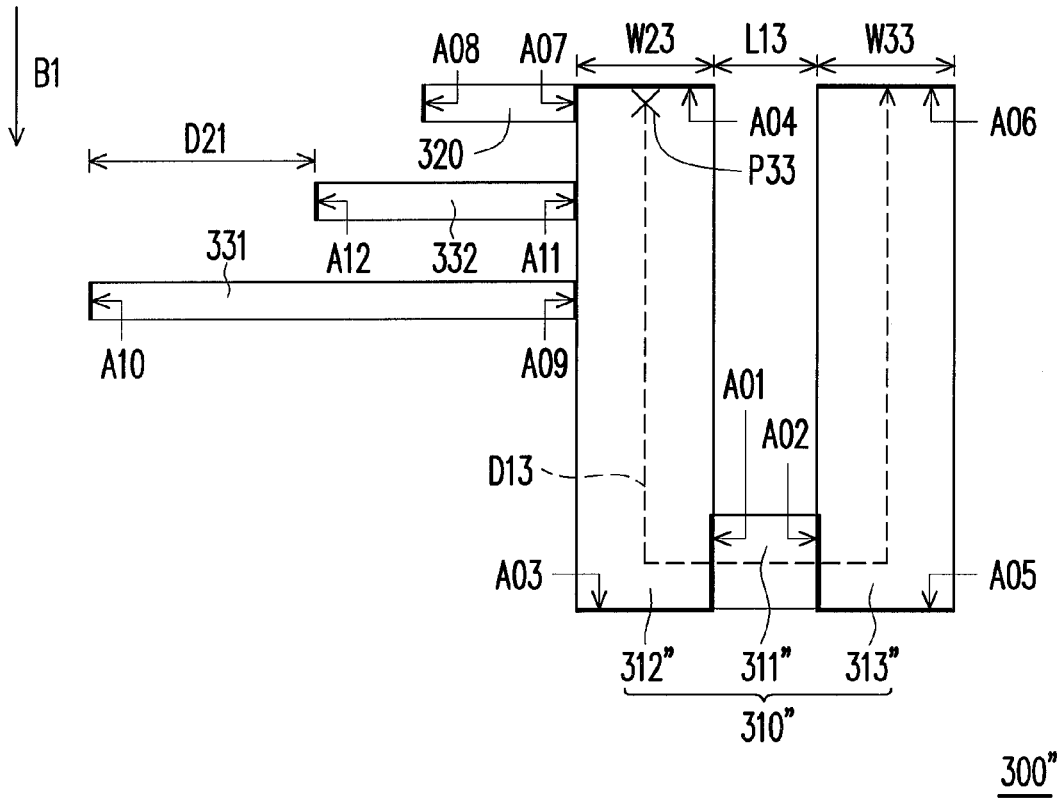
FIG. 3C illustrates a structural view of a planar inverted-F antenna according to yet another embodiment of the present invention.

FIG. 3C illustrates a structural view of a planar inverted-F antenna according to yet another embodiment of the present invention. With reference to FIG. 3A and FIG. 3C, the main differences between the third and the above embodiments are the changes of the width of a body part 310", the flowing direction and length of a current path D13, and the sequence and arrangement of the feeding part 320, the first grounding part 331, and the second grounding part 332.

Specifically, in this embodiment, the body part 310" includes a first conductive element 311", a second conductive element 312", and a third conductive element 313". The current path D13 on the body part 310" goes from a feeding point P33 through the ends A01 and A02 to the end A06. In view of the configuration of the elements in a planar inverted-F antenna 300", the second end A07 of the feeding part 320 is electrically connected to the second conductive element 312" via the feeding point P33. The first grounding part 331, the second grounding part 332, and the feeding part 320 are arranged in parallel to one another. Moreover, the first grounding part 331 and the second grounding part 332 are located on one side of the feeding part 320 along the direction B1 towards the first end A03 of the second conductive element 312". Furthermore, the feeding part 320, the second grounding part 332, and the first grounding part 331 are sequentially disposed on one side of the second conductive element 312" along the direction B1 towards the first conductive element 311".

As shown in FIG. 3C, the width of the first conductive element 311" is marked as W13, the width of the second conductive element 312" is marked as W23, and the width of the third conductive element 313" is marked as W33. Specifically, the width W33 of the third conductive element 313" is larger than the width W13 of the first conductive element 311", and the width W23 of the second conductive element 312" is larger than the width W13 of the first conductive element 311" as well, wherein a ratio (W33/W23) of the width W33 of the third conductive element 313" to the width W23 of the second conductive element 312" is equal to 1. A ratio (W23/W13 or W33/W13) of the width of the second conductive element 312" or the third conductive element 313" to the width W13 of the first conductive element 311" is in a range of 1.5 and 2. To be more detailed, the first grounding part 331 and the second grounding part 332 in this embodiment have influence on the intensity and distribution of the excitation current. That is, the first grounding part 331 and the second grounding part 332 absorb a portion of excitation current and therefore reduce the excitation current in the current path D13. To eliminate the influence caused by the first grounding part 331 and the second grounding part 332, in this embodiment, the width W23 of the second conductive element 312' and the width W33 of the third conductive element 313' are enlarged to increase the excitation current, so as to compensate for the excitation current absorbed by the first grounding part 331 and the second grounding part 332.

In addition, similar to the first embodiment, the body part 310" is corresponding to a resonance length, and the resonance length is ⅓~⅕ time of the wavelength at operating frequency, preferably ¼ times of the wavelength at operating frequency of a radiation wave received or transmitted by the body part 310". A current path from the first grounding part 331 to the feeding part 320 along the body part 310" is ½ times of the resonance length at operating frequency. A relative distance D21 between the second grounding part 332 and the first grounding part 331 is ¼ times the resonance length. Based on the design of the first grounding part 331 and the second grounding part 332, the planar inverted-F antenna 300" as described in this embodiment is able to generate two perpendicular linearly polarized waves for forming the radiation wave which approximates to circular polarization. Details of this embodiment have been described in the above embodiments and therefore not repeated hereinafter.

In conclusion of the above, the planar inverted-F antenna according to the present invention uses double groundings to generate linearly polarized waves and thereby forms the radiation wave which approximates circular polarization. Accordingly, the planar inverted-F antenna of the present invention has advantages in terms of miniaturization and is applicable to the transmission of radiation wave between global positioning systems, electronic products, and satellites.

Although the present invention has been disclosed by the above embodiments, they are not intended to limit the present invention. Any person having ordinary knowledge in the art may make modifications and variations without departing from the spirit and scope of the present invention. Therefore, the scope of protection sought by the present invention falls in the appended claim.

What is claimed is:

1. An antenna with double groundings, comprising:

a body part corresponding to a resonance length for transmitting and receiving a radiation wave with a wavelength at an operating frequency;

a feeding part electrically connected to the body part;

a first grounding part electrically connected to the body part, and a current path from the end of the first grounding part along the full length of the first grounding part through the body part to the end of feeding part along the full length of the feeding part being ½ times of the wavelength at the operating frequency; and a second grounding part electrically connected to the body part, and a relative difference in length being maintained between the second grounding part and the first grounding part.

2. The antenna as claimed in claim 1, wherein the resonance length is ⅓~⅕ times of the wavelength at the operating frequency.

3. The antenna as claimed in claim 1, wherein the body part comprises:

a first conductive element having a first end and a second end;

a second conductive element having a first end and a second end, wherein the first end of the second conductive element is electrically connected to the first end of the first conductive element, and the second conductive element is electrically connected to the feeding part, the first grounding part, and the second grounding part; and a third conductive element having a first end and a second end, wherein the first end of the third conductive element is electrically connected to the second end of the first conductive element.

4. The antenna as claimed in claim 3, wherein the second conductive element is electrically connected to the feeding part via a feeding point, and a current path from the feeding point to the second end of the third conductive element is equal to the resonance length at the operating frequency.

5. The antenna as claimed in claim 3, wherein the first grounding part and the second grounding part are arranged on one side of the feeding part along a direction towards the second end of the second conductive element, and the widths of the first conductive element, the second conductive element, and the third conductive element are equal to one another.

6. The antenna as claimed in claim 3, wherein the first grounding part and the second grounding part are respectively disposed on two sides of the feeding part, and the width of the third conductive element is larger than the width of the second conductive element.

7. The antenna as claimed in claim 6, wherein a ratio of the width of the third conductive element to the width of the second conductive element is in a range of 1.5 to 2.

8. The antenna as claimed in claim 3, wherein the first grounding part and the second grounding part are arranged on one side of the feeding part along a direction towards the first end of the second conductive element, and the widths of the second conductive element and the third conductive element are respectively larger than the width of the first conductive element.

9. The antenna as claimed in claim 8, wherein a ratio of the width of the second conductive element to the width of the first conductive element and a ratio of the width of the third conductive element to the width of the first conductive element are in a range of 1.5 to 2.

10. The antenna as claimed in claim 1, wherein the first grounding part and the second grounding part are used for adjusting an impedance matching of the antenna.

11. The antenna as claimed in claim 1, wherein the antenna generates two orthogonal linearly polarized waves through the first grounding part and the second grounding part to form the radiation wave.

12. The antenna as claimed in claim 1, wherein the antenna is adapted to receiving or transmitting the radiation wave from a global positioning system.

13. The antenna as claimed in claim 1, wherein the relative difference in length between the first grounding part and the second grounding part is ¼ times the of wavelength at the operating frequency.

14. An antenna with double groundings, comprising:

a body part having a feeding point to extend a resonance length for receiving or transmitting a radiation wave with wavelength at an operating frequency;

a feeding part electrically connected to the body part via the feeding point; and a first and a second grounding parts arranged in parallel to the feeding part and electrically connected to the body part, wherein a current path from the end of the first grounding part along the full length of the first grounding part through the body part to the end of the feeding part along the full length of the feeding part is ½ times of the wavelength at the operating frequency, and a relative difference in length between the first grounding part and the second grounding part is ¼ times of the wavelength at the operating frequency.

15. The antenna as claimed in claim 14, wherein the resonance length is ⅓~⅘ times of the wavelength of the radiation wave.

16. The antenna as claimed in claim 14, wherein the body part comprises:

a first conductive element having a first end and a second end;

a second conductive element having the feeding point and electrically connecting the first end of the first conductive element, the feeding part, the first and the second grounding parts; and a third conductive element electrically connected to the second end of the first conductive element, and a current path from the feeding point of the second conductive element to the third conductive element is equal to the resonance length.

17. The antenna as claimed in claim 16, wherein the second grounding part, the first grounding part, and the feeding part are sequentially arranged on one side of the second conductive element along a direction towards the first conductive element, and the widths of the first conductive element, the second conductive element, and the third conductive element are equal to one another.

18. The antenna as claimed in claim 16, wherein the second grounding part, the feeding part, and the first grounding part are sequentially arranged on one side of the second conductive element along a direction towards the first conductive element, the first grounding part and the second grounding part are respectively disposed on two sides of the feeding part, and the width of the third conductive element is larger than the width of the second conductive element.

19. The antenna as claimed in claim 16, wherein the feeding part, the second grounding part, and the first grounding part are sequentially arranged on one side of the second conductive element along a direction towards the first conductive element, and the widths of the second conductive element and the third conductive element are respectively larger than the width of the first conductive element.

20. The antenna as claimed in claim 14, wherein the first grounding part and the second grounding part are used for adjusting an impedance matching of the antenna.

21. The antenna as claimed in claim 14, wherein the antenna generates two orthogonal linearly polarized waves through the first grounding part and the second grounding part to form the radiation wave.

22. The antenna as claimed in claim 14, wherein the antenna is adapted to receiving or transmitting the radiation wave from a global positioning system.

* * * * *